United States Patent [19]

Wright

[11] 4,272,395

[45] Jun. 9, 1981

[54] GERMICIDAL COMPOSITIONS

[75] Inventor: Robert J. Wright, London, England

[73] Assignee: Lever Brothers Company, New York, N.Y.

[21] Appl. No.: 106,072

[22] Filed: Dec. 20, 1979

Related U.S. Application Data

[63] Continuation of Ser. No. 910,550, May 30, 1978, abandoned.

[51] Int. Cl.[3] ..... C11D 1/62; C11D 3/48

[52] U.S. Cl. ..... 252/106; 252/107; 252/545; 252/547; 252/548

[58] Field of Search ..... 252/106, 528, 547, 529, 252/548, 550, 551, 554, 555, 558, DIG. 14; 424/329

[56] References Cited

U.S. PATENT DOCUMENTS

| | | | |
|---|---|---|---|
| 3,247,119 | 4/1966 | Herrick et al. | 252/106 |
| 3,539,520 | 11/1970 | Cantor et al. | 252/106 |
| 3,836,669 | 9/1974 | Dadekian | 424/329 |
| 3,965,026 | 6/1976 | Lancz | 252/106 |
| 3,983,079 | 9/1976 | Spadini et al. | 252/545 |
| 3,994,818 | 11/1976 | Vander Loo et al. | 252/171 |
| 4,065,409 | 12/1977 | Flanagan | 252/528 |

FOREIGN PATENT DOCUMENTS

| | | |
|---|---|---|
| 525648 | 5/1956 | Canada . |
| 525649 | 5/1956 | Canada . |
| 575731 | 5/1959 | Canada . |
| 2283667 | 4/1976 | France . |
| 6802352 | 8/1968 | Netherlands . |
| 1050791 | 12/1966 | United Kingdom . |
| 1538094 | 1/1979 | United Kingdom . |
| 1538866 | 1/1979 | United Kingdom . |

OTHER PUBLICATIONS

Ditoro, R. D., "New Generation of Biologically Active Quaternaries," Soap and Chemical Specialties, Mar. 1969, pp. 47, 48, 50, 52, 86, 88, 91 and 92.

*Primary Examiner*—P. E. Willis, Jr.

*Attorney, Agent, or Firm*—James J. Farrell; Melvin H. Kurtz; Irving N. Feit

[57] ABSTRACT

A high foaming germicidal detergent composition suitable for use in dishwashing and in the cleaning and disinfecting of hard surfaces is obtained by combining essentially a quaternary ammonium compound having a formula

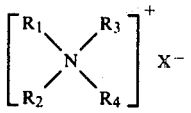

wherein $R_1$ and $R_2$ are alkyl groups each having 9 to 11 carbon atoms; $R_3$ and $R_4$ can each be an alkyl group, an alkyl ether group or a hydroxyalkyl group having 1-3 carbon atoms, or a benzyl group; and $X^-$ is $Cl^-$, $Br^-$, $I^-$, $NO_3^-$, $\frac{1}{2}$ $SO_4^{2-}$, $CH_3SO_4^-$, $C_2H_5SO_4^-$, $\frac{1}{2}$ $HPO_4^{2}$ or $CH_3COO^-$;

and a co-surfactant selected from the group consisting of short chain anionic surfactants having 3-8 carbon atoms in the hydrophobic group, low alkoxylated nonionic surfactants having 0-4 ethylene oxide and/or propylene oxide groups in the molecule, and mixtures thereof.

4 Claims, No Drawings

GERMICIDAL COMPOSITIONS

This is a continuation application of Ser. No. 910,550, filed May 30, 1978, now abandoned.

The invention relates to germicidal compositions, more particularly the invention relates to germicidal compositions based on cationic surfactants suitable for use in dishwashing and in the cleaning and disinfecting of hard surfaces.

The invention also relates to a method of washing dishes and general hard surface cleaning utilising such germicidal compositions.

Liquid detergent compositions, such as are suitable for use in the manual washing of dishes, are well known in the art. They are, however, generally non-germicidal and are based on synthetic anionic detergents to give them satisfactory foaming properties. For a long time, however, industrial detergent manufacturers have been attempting to develop a good quality detergent sanitizer which would be suitable for manual dishwashing, etc., having the desired properties of combination of good foaming and cleaning, mildness to the skin, and a significant reduction of the chance of cross contamination within the wash solution and an effective sanitization of the washed surface.

Germicidal dishwashing liquids with foam behaviour which is inferior to conventional anionic dishwashing products have been known and on the market for some time. These are all composed of nonionic detergents with added quaternary ammonium compounds as germicide and are generally fairly effective sanitizers but are extremely poor dishwashing agents. The very low foaming properties, particularly in the presence of soil and poor wetting, of nonionic detergents in general are exhibited by such formulations.

These cationic quaternary ammonium compounds are low foamers and they cannot normally be formulated with high foaming anionic surfactants since insoluble complexes are formed between the oppositely charged surfactant ions. Thus nonionic surface-active agents have been seen as the only real possibility for achieving detergent properties in the germicidal formulation. The traditional philosophy has therefore been that a quaternary based detergent sanitizer must have at least two components which perform separate functions, i.e. a quaternary ammonium compound acting as germicide and a nonionic compound as detergent.

The present generation germicidal dishwashing products have to be dosed at high levels in order to get even the minimum requirements of foaming and their germicidal effect is reduced by the presence of large amounts of nonionic substance which tends to lower the activity of the quaternary ammonium compound in solution by solvation of micelles.

British Patent Specification No. 1,050,791 describes that water-soluble equimolecular cationic/anionic complexes can be made by specific selection of the cationic and anionic surface-active agents. The cationic used is a $C_4$–$C_{16}$ alkyl trimethyl ammonium salt and the anionic surfactant used has an alkyl or acyl radical of from 4 to 16 carbon atoms, the two components being selected such that the combined total of the carbon atoms in the cationic alkyl radical and the anionic alkyl radical is from 18 to 22.

A major drawback of these complexes is, however, lack of germicidal effect.

A formulation composed of a 1:1 weight ratio of dodecyl trimethyl ammonium chloride and p-octyl sulphonate was tested and found to give a high foam performance indeed, but its germicidal effect was very poor under realistic conditions. Skin irritance tests carried out with this formulation have also shown that it was very irritant to the skin. It is likely that the lack of germicidal activity of this type of formulation can be explained by the large proportion of anionic, and the irritancy could also be related to this factor.

Accordingly it is an object of the present invention to provide a high foam profile to a germicidal quaternary ammonium compound without substantial loss of germicidal properties.

It is another object of the present invention to provide a product based on quaternary ammonium compounds, which exhibits excellent germicidal properties together with a high foaming behaviour.

Still another object of the invention is to provide a liquid germicidal cationic detergent composition which is comparable in foaming behaviour and dishwashing performance with conventional anionic based dishwashing liquids.

A further object of the invention is to provide an effective germicidal detergent composition showing good foam stability in the presence of soil.

A still further object is to provide an improved formulation for a germicidal dishwashing liquid and for a disinfecting detergent sanitizer showing a high foaming behaviour.

It has now been found that the foregoing objects are attained by combining a specific type of cationic surfactants, as defined hereinafter, with a co-surfactant selected from the group consisting of short chain anionic surfactants having 3–8 carbon atoms in the hydrophobic group, and low alkoxylated nonionic surfactants having 0–4 ethylene oxide and/or propylene oxide groups in the molecule, and mixtures thereof.

The cationic surfactant used in the present invention is a quaternary ammonium compound having the formula:

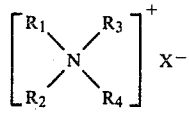

wherein $R_1$ and $R_2$ are each alkyl groups having 9 to 11 carbon atoms; $R_3$ and $R_4$ can each be an alkyl group, an alkylether group or a hydroxyalkyl group having 1–3 carbon atoms, or a benzyl group; and $X^-$ is either $Cl^-$, $Br^-$, $I^-$, $NO_3^-$, $\frac{1}{2}SO_4^{2-}$, $CH_3SO_4^-$, $C_2H_5SO_4^-$, $\frac{1}{2}HPO_4^{2-}$ or $CH_3COO^-$.

The quaternary ammonium compounds as used in the present invention are not novel and have been described in Canadian Patent Specification No. 910,191 and in Soap & Chemical Specialties, March 1969, pages 47–48/50/52/86/88/91/92. Though the literature also discloses the high tolerance of these quaternary ammonium compounds to anionic detergents, it was found that compositions comprising conventional anionic surfactants having more than 8 carbon atoms in the hydrophobic group or conventional nonionic detergents having more than 4 ethylene oxide groups are poor foamers as compared with compositions of the present invention.

The short chain anionic surfactant may be any of the organic water-soluble single, double or triple charged sulphonates, sulphates, phosphates or carboxylic acid salts, such as the primary or secondary $C_3$–$C_8$ alkyl sulphonates, sulphates and phosphates; primary or secondary $C_3$–$C_8$ alkyl ethersulphates having 1–6 ethylene oxide groups; mono- or di-alkylbenzene sulphonates having 0–2 carbon atoms in the alkyl chain; and natural or synthetic $C_3$–$C_8$ fatty acid soaps.

Examples of such short chain anionic surfactants are sodium hexyl sulphonate, potassium hexyl sulphonate, ammonium heptyl sulphonate, sodium hexyl sulphate, potassium amyl sulphate, ammonium hexyl sulphate, sodium hexyl phosphate, potassium butyl phosphate, ammonium hexyl phosphate, sodium hexyl-3(ethoxy)-sulphate, and sodium and potassium toluene and xylene sulphonates.

Preferred anionic surfactants are those having 4–7 carbon atoms in the hydrophobic group, the alkali metal $C_4$–$C_7$ alkyl sulphonates and sulphates such as Na-pentyl sulphonate, Na-pentyl sulphate, Na-hexyl sulphonate and Na-hexyl sulphate being particularly preferred.

Suitable nonionic surfactants are those low alkoxylated nonionics having 0–4 moles of ethylene oxide and/or propylene oxide per mole, such as the primary or secondary ethoxylated or propoxylated $C_8$–$C_{16}$ alkanes containing 1–4 moles ethylene oxide or propylene oxide per mole, and the alkyl mono- and diethanolamides of carbon chain length $C_{10}$–$C_{16}$. Examples of such suitable nonionics are coconut fatty acid monoethanolamide, coconut fatty acid diethanolamide, and $C_{11}$–$C_{15}$ secondary alcohol, condensed with 3 ethylene oxide groups, known under the trade name of Tergitol 15-S-3, supplied by Union Carbide Corp. ("Tergitol" is a registered trade mark).

Accordingly the invention provides a germicidal detergent composition comprising essentially an active mixture of a quaternary ammonium compound having the formula:

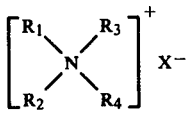

wherein $R_1$ and $R_2$ are alkyl groups each having 9 to 11 carbon atoms; $R_3$ and $R_4$ can each be an alkyl group, an alkylether group or a hydroxyalkyl group having 1–3 carbon atoms, or a benzyl group; and $X^-$ is either $Cl^-$, $Br^-$, $I^-$, $NO_3^-$, $\frac{1}{2}SO_4^{2-}$, $CH_3SO_4^-$, $C_2H_5SO_4^-$, $\frac{1}{2}HPO_4^{2-}$ or $CH_3COO^-$, and a co-surfactant selected from the group consisting of short chain anionic surfactants having 3–8 carbon atoms in the hydrophobic group, low alkoxylated nonionic surfactants having 0–4 ethylene oxide and/or propylene oxide groups in the molecule, and mixtures thereof.

Preferred quaternary ammonium compounds are those wherein $R_1$ and $R_2$ are alkyl groups of equal chain length having 9 to 11 carbon atoms; $R_3$ and $R_4$ are each an alkyl group having 1 to 3 carbon atoms; and $X^-$ is a halogen ion.

Examples of suitable quaternary ammonium compounds are:

dinonyl dimethyl ammonium chloride
didecyl dimethyl ammonium chloride
diundecyl dimethyl ammonium chloride
didecyl diethyl ammonium chloride
didecyl dimethyl ammonium bromide
didecyl dimethyl ammonium iodide
dinonyl methyl ethyl ammonium chloride.

Though the ratio of the co-surfactant to the quaternary ammonium compound in the compositions is not very critical and may vary within a rather wide range, it will be of advantage to have the co-surfactant in minor proportions of the quaternary ammonium compound.

Suitable compositions of the invention will generally comprise an active mixture of 30–98 parts by weight of the quaternary ammonium compound as defined above, 0–70 parts by weight of the short chain anionic co-surfactant as defined above, and 0–25 parts by weight of the low alkoxylated nonionic co-surfactant as defined above, the anionic and/or nonionic co-surfactants being present in at least 5 parts by weight.

Preferred compositions are those wherein the anionic co-surfactant as defined above is present as the sole co-surfactant or together with a nonionic co-surfactant.

Hence, in one preferred embodiment of the invention the composition comprises an active mixture of 30–98, preferably 50–95 parts by weight of said quaternary ammonium compound, 5–70, preferably 5–50 parts by weight of said anionic co-surfactant and 0–25, preferably 0–20 parts by weight of said nonionic co-surfactant.

Without detracting from the inventive concept, the composition may further comprise any of the usual ingredients which could improve consumers' acceptance, e.g. colouring substances, perfume, etc.

The composition of the invention may be presented in any physical form, e.g. as solid particles or preferably as an aqueous paste or an aqueous liquid solution, which on use can be diluted to any desirable concentration.

Optimum foaming liquid formulations can be made up in the form of translucent stable liquids with no added hydrotropes or non-aqueous solvents. The mixed charge liquids form structured viscoelastic-systems at active detergent concentrations as low as a few percent, but are easily pourable up to about 20% active-detergent content. These aqueous systems can be delivered from a normal domestic squeeze bottle or by a Venturi pump tap proportioner. Non-alcohol containing liquid compositions of the invention can be prepared which are quite stable over a wide range of temperatures, preferred concentrations being about 10% by weight of total active detergent components.

EXAMPLES I–IV

The following four liquid compositions were prepared:

| | I % | II % | III % | IV % |
|---|---|---|---|---|
| Didecyl dimethyl ammonium chloride | 9 | 9.5 | 9.2 | 8 |
| Sodium hexyl sulphonate | 1 | 0.5 | — | — |
| Coco-monoethanol amide (CEA)[1] | — | — | 0.8 | — |
| Tergitol ® 15-S-3[2] | — | — | — | 2 |
| Water | 90 | 90 | 90 | 90 |

[1]CEA = $C_{12}H_{25}—CON\begin{matrix}CH_2CH_2OH\\H\end{matrix}$

[2]"Tergitol" is a trade-mark of Union Carbide Corporation.
Tergitol 15-S-3 = $C_{11}$—$C_{15}$ alkyl-O—$(CH_2CH_2O)_3H$ The compositions were tested for germicidal activity.

The germicidal activity of the compositions was measured by means of a standard suspension test as described below in the presence of 5.4% canteen soiling (0.4% solids in the solution); 0.05% active material was used, and also by means of the more practical wash bowl test.

Standard suspension test for germicidal activity

| Test organisms: | |
|---|---|
| *Escheria coli* | ATCC 11229 |
| *Pseudomonas aeruginosa* | ATCC 15442 |
| *Salmonella typhimurium* | ATCC 13311 |
| *Shigella sonnei* | ATCC 10014 |

Experimental:

The tests were carried out at 20° C. and 40° C.

Put 1 ml of the strain suspension including the soil into a 100 ml Erlenmeyer flask containing the diluted disinfectant. The dilution of the disinfectant should be such that the required concentration is obtained with 25 ml of the total test solution.

After a reaction time of 5, 10 and 15 minutes, 1 ml of the liquid is pipetted into 9 ml of inactivating liquid. The number of surviving bacteria is then determined in a suitable agar medium after incubation for 2 days at 32° C.

Evaluation:

The bacterial action can be expressed as a log decimal reduction:

Germ-killing effect (GE) = Log $N_o/N_t$ $N_o$ = number of bacteria which can be grown before the disinfectant has acted.

$N_t$ = number of bacteria which can be grown after the disinfectant has been acting for t minutes.

| Canteen soiling: | % |
|---|---|
| Protein (albumen) | 0.9 |
| Fatty acid (oleic) | 0.15 |
| Fat (cooking fat) | 2.475 |
| Starch (P 10 X) | 3.975 |
| Water | to 100. |

At 20° C. all four compositions gave quite sufficient killing on *E.Coli, S.typnimurium* and *S.sonnei* (GE > 5.0), but less killing on *P.aeruginosa.* At 40° C. quite sufficient killing was obtained for all test strains.

The compositions were also tested for their germicidal activity using a more practical test method as described below.

Wash bowl test for germicidal activity

Principle:

Soiled stainless steel plates are washed for one minute under constant pressure using a rotating brush. Afterwards the number of surviving bacteria on the plates and in the wash liquor is determined.

Test organisms:

*Shigella sonnei*

*Salmonella typhimurium.*

Experimental:

Canteen-soiling (see above) is mixed with the test strain so that there are approximately $10^7$ organisms/g soiling. 1 g. of this mixture is put on to a stainless steel plate (4×4 cm) and allowed to dry for two hours at 20° C. and 70% RH. The plates are then washed; after the washing of each plate an extra amount of soiling is added to the wash liquor (5 g/3 l) to increase the soil level.

After the fifth and tenth plate are washed, a sample of the wash liquor is taken in order to estimate the number of bacteria in it.

To inactivate spores of biocides present on the plates after washing, each plate is covered with 5 ml inactivation liquid. After five minutes each plate is put in a petri dish and 1 ml of the inactivation liquid in another petri dish and a nutrient is added. The bacteria are counted after incubation for two days at 32° C.

All four compositions were quite satisfactory in the wash bowl test.

The compositions were also tested for foam behaviour in a plate washing test at a dosage of 0.05% active detergent using water of 24° H. The number of artificially soiled plates that can be washed in the bowl until foam disappears was recorded. A commercial liquid germicidal product was used for comparison.

The following results were obtained:

| Product/composition | Plates score | Description of product |
|---|---|---|
| I | 26–28 | |
| II | 22 | Compositions of |
| III | 19 | the invention |
| IV | 14–17 | |
| Lauryl alcohol + 12 ethylene oxide 18.36% | 7 | Commercial liquid germicidal product |
| Lauryl dimethylbenzyl ammonium chloride (6.12%) Water 75.52% | | |

EXAMPLE V

Liquid compositions were prepared containing didecyl dimethyl ammonium chloride (DDQ) and varying amounts of sodium hexyl sulphonate ($C_6SO_3Na$).

The compositions were tested for foam behaviour in a plate washing test at a dosage of 0.05% total active detergent using water of 24° H., as described in Examples I–IV.

| Compositions | Plates score |
|---|---|
| $V_1$ + $C_6SO_3Na$ at 0% of total active (DDQ + $C_6SO_3Na$) | 10 |
| $V_2$ + $C_6SO_3Na$ at 1% of total active (DDQ + $C_6SO_3Na$) | 14 |
| $V_3$ + $C_6SO_3Na$ at 5% of total active (DDQ + $C_6SO_3Na$) | 22 |
| $V_4$ + $C_6SO_3Na$ at 10% of total active (DDQ + $C_6SO_3Na$) | 28 |
| $V_5$ + $C_6SO_3Na$ at 20% of total active (DDQ + $C_6SO_3Na$) | 20 |

EXAMPLE VI

The foaming behaviour of the following didecyl dimethyl ammonium chloride/co-surfactant mixtures was determined in a 500 ml measuring cylinder with no soil added, using 100 mls of solutions in demineralised water at 0.05% by weight of detergent concentration.

| Co-surfactant | Quat./surfactant weight ratio: | Foam volumes ($cm^3$) Initial | After 200 sec. |
|---|---|---|---|
| p-hexyl $SO_3Na$ | 25:1 | 122 | 120 |
| Tergitol 15-S-3[1] | 1:1 | 110 | 110 |
| Tergitol 15-S-9[2] | 1:1 | 110 | 0 |
| Tergitol 15-S-11[3] | 1:1 | 100 | 25 |
| Tergitol 45-S-5[4] | 1:1 | 54 | 54 |
| Dobanol 25-12-EO[5] | 1:1 | 62 | 62. |

[1]$C_{11}$–$C_{15}$ alkyl-O$(C_2H_4O)_3H$ supplied by Union Carbide Corp.
[2]$C_{11}$–$C_{15}$ alkyl-O$(C_2H_4O)_9H$ supplied by Union Carbide Corp.
[3]$C_{11}$–$C_{15}$ alkyl-O$(C_2H_4O)_{11}H$ supplied by Union Carbide Corp.
[4]$C_{14}$–$C_{15}$ alkyl-O$(C_2H_4O)_5H$ supplied by Union Carbide Corp.
[5]$C_{12}$–$C_{15}$ alkyl-O$(C_2H_4O)_{12}H$ supplied by Shell Chem. Company.

EXAMPLE VII

The foaming behaviour of the following didecyl dimethyl ammonium chloride/co-surfactant mixtures was determined in a 100 ml measuring cylinder with gravy soil incrementally added, using 30 mls solution in tap water at 0.05% by weight of detergent concentration.

| Co-surfactant | Quat./co-surfactant molar ratio | Foam volume($cm^3$) after 2 ml of soil added |
|---|---|---|
| p-hexyl $SO_3Na$ | 4:1 | 21 |
| p-hexyl $SO_3Na$ | 1:1 | 13 |
| Na-xylene sulphonate | 1:1 | 10 |
| p-decyl $SO_3Na$ | 1:1 | 3 |
| | Weight ratio | |
| Tergitol 15-S-3 | 4:1 | 17 |
| Lauric acid monoethanolamide | 3:1 | 12 |
| Coconut fatty acid monoethanolamide | 9:1 | 19 |
| Dobanol 25-12 EO | 1:1 | 2. |

EXAMPLE VIII

Four commercial sources of didecyl dimethyl ammonium chloride were tested, viz (a) Onyx BTC 1010, supplied by the Onyx Company.
(b) Querton 210 CL, supplied by the Kemanord Company.
(c) Bardac 22, supplied by Lonza Inc.
(d) Dodigen 1881, supplied by Hoechst.

Results of the plate washing test using mixtures of said quaternary ammonium compounds with p-hexyl sulphonate at 9:1 weight ratio, at a dosage of 0.05% total active detergent concentration in London water, with standard gravy soil carried out at 45° C. are as follows:

| | Number of plates washed |
|---|---|
| Onyx BTC 1010 | 31 |
| Querton 210 CL | 28–29 |
| Bardac 22 | 26 |
| Dodigen 1881 | 24 |

The differences, although not large, probably indicate real variations in the effectiveness of the commercial products as influenced by purity levels.

The superiority of Querton 210 CL to Bardac 22 was also demonstrated by plate tests on 4:1 mixtures with a nonionic co-surfactant using the same test-conditions.

| | | Number of plates washed |
|---|---|---|
| Querton 210 Cl | + Tergitol 15-S-3 | 17 |
| Bardac 22 | + Tergitol 15-S-3 | 14 |

The four commercial materials were analysed by Mass Spectrometry and the main impurities found were the $C_8$, $C_{10}$-dialkyl compound and the $C_{10}$-trialkyl species:

| | Alkyl chain length $C_{10}$ (wt %) | $C_8$ (wt %) | Trialkyl | Other |
|---|---|---|---|---|
| Onyx BTC 1010 | 98 | 2 | — | — |
| Querton 210 CL | 85 | 15 | — | — |
| Bardac 22 | 75 | 25 | + | — |
| Dodigen 1881 | 100 | 0 | + | sec. $C_8$- and $C_{10}$ alcohols. |

It appears therefore that the ranking in foam performance of the formulations can be explained in terms of the impurities detected by this technique. The relative performances of the first three products correlate sensibly with the chain length purity of the materials. Dodigen 1881 is composed of dialkyl quaternary which is essentially of just the $C_{10}$ chain length; however, it does contain detectable trialkyl impurities and alcohols which possibly may act as foam depressants.

No significant differences have been found in the germicidal effect of these four commercial materials.

EXAMPLE IX

Plate washing tests were carried out with the following mixtures. The test conditions were the same as those used in Example VIII.

| | Number of plates washed |
|---|---|
| Querton 210 CL/Na—p-hexyl sulphonate (9:1) | 28 |
| Querton 210 CL/Na—p-hexyl sulphate (9:1) | 23 |
| Onyx BTC 1010/Na—iso-amylsulphate (5:1) | 32 |
| Onyx BTC 1010/Na—p-hexyl sulphonate (9:1) | 31 |
| Onyx BTC 1010/Na—p-pentyl sulphate (8:1) | 30. |

EXAMPLE X

The following liquid compositions were tested for their germicidal activity using the Quantitative Suspension Test published by the Dutch Committee on Phytopharmacy.

| Composition | $X_1$ % | $X_2$ % | $X_3$ % | $X_4$ % | E % |
|---|---|---|---|---|---|
| Querton 210CL | 9 | 9 | 9 | 9 | 9 |
| Na-butyl sulphate | 1 | — | — | — | — |
| Na-pentyl sulphate | — | 1 | — | — | — |
| Na-hexyl sulphate | — | — | 1 | — | — |
| Na-octyl sulphate | — | — | — | 1 | — |
| Na-decyl sulphate | — | — | — | — | 1 |
| Water | 90 | 90 | 90 | 90 | 90 |

Principle of the test:

A suspension of the test organism and a solution of the organic soiling are mixed and then added to the test solution in such a way that the soil concentration in the mixture obtained is 0.03% bovine albumen. After a prescribed contact time at a prescribed temperature the number, of surviving organisms is estimated.

Procedure:

Mix equal volumes of bacterial or spore suspension and albumen solution (1.5%).

After 2 minutes, add 1 ml of this mixture to the disinfectant dilution and after 5 minutes, transfer 1 ml of the disinfectant/organisms mixture into 9 ml of a universal inactivation liquid at 20° C. and mix well. After 5 minutes dilutions are made so that not more than 200 organisms/ml are present and, if possible, not less than 20.

Pipet 1 ml of this dilution into a petri dish to prepare pour plates with 20 ml tryptone-soya-peptone agar melted and cooled at 43° C.

Incubate the petri dishes at 32° C. (±2° C.) for 48 hours. Count the number of columns and thus calculate the number of surviving organisms per ml test solution.

The germicidal effect after 5 min. contact time at 20° C. are expressed as log decimal reduction (GE).

The results of the tests (average of two tests) are shown in the following Tables:

TABLE A

Use concentration: 1 gr/liter
RESULTS: Expressed as log decimal reduction

| TEST STRAINS | Initial count/ml | Contact time/ | $X_1$ | $X_2$ | $X_3$ | $X_4$ | E |
|---|---|---|---|---|---|---|---|
| *Pseudomonas aeruginosa* ATCC 15442 | $7.2 \times 10^7$ | 5 min. | 2.6 | 6.0 | 1.0 | <1.0 | <1.0 |
| *Proteus mirabilis* ATCC 14153 | $2.3 \times 10^8$ | 5 min. | 2.4 | 3.5 | 1.4 | <1.0 | <1.0 |
| *Salmonella typhimurium* ATCC 13311 | $1.4 \times 10^8$ | 5 min. | 6.0 | >7.1 | 2.5 | 1.8 | <1.0 |
| *Staphylococcus aureus* ATCC 6538 | $3.8 \times 10^8$ | 5 min. | >7.6 | >7.6 | 5.9 | 3.2 | 2.8 |
| *Candida albicans* ATCC 10231 | $9.0 \times 10^6$ | 5 min. | 53 | >5.9 | 1.2 | <1.0 | <1.0 |

TABLE B

Use concentration: 3 gr/liter
RESULTS: Expressed as log decimal reduction

| TEST STRAINS | Initial count/ml | Contact time/ | $X_1$ | $X_2$ | $X_3$ | $X_4$ | E |
|---|---|---|---|---|---|---|---|
| *Pseudomonas aeruginosa* ATCC 15442 | $2.8 \times 4^7$ | 5 min. | 4.8 | >6.5 | <1.0 | <1.0 | <1.0 |
| *Proteus mirabilis* ATCC 14153 | $5.0 \times 10^7$ | 5 min. | 3.4 | 6.7 | <1.0 | <1.0 | <1.0 |
| *Salmonella typhimurium* ATCC 13311 | $8.4 \times 10^7$ | 5 min. | >6.9 | >6.9 | >6.9 | 3.0 | <1.0 |
| *Staphylococcus aureus* ATCC 6538 | $3.2 \times 10^7$ | 5 min. | >6.5 | >6.5 | >6.5 | 3.3 | 1.5 |
| *Candida albicans* ATCC 10231 | $9.1 \times 10^7$ | 5 min. | 6.3 | >6.9 | 6.2 | <1.0 | <1.0 |

TABLE C

Use concentration: 5 gr/liter
RESULTS: Expressed as log decimal reduction

| TEST STRAINS | Initial Count/ml | Contact time/ | $X_1$ | $X_2$ | $X_3$ | $X_4$ | E |
|---|---|---|---|---|---|---|---|
| *Pseudomonas aeruginosa* ATCC 15442 | $2.8 \times 10^7$ | 5 min. | 4.8 | 6.0 | <1.0 | <1.0 | <1.0 |
| *Proteus mirabilis* ATCC 14153 | $5.0 \times 10^7$ | 5 min. | 3.4 | 6.7 | <1.0 | <1.0 | <1.0 |
| *Salmonella typhimurium* ATCC 13311 | $8.0 \times 10^7$ | 5 min. | >6.9 | >6.9 | >6.9 | 5.4 | <1.0 |
| *Staphylococcus aureus* ATCC 6538 | $1.3 \times 10^8$ | 5 min. | 6.8 | >7.1 | >7.1 | 5.1 | 2.1 |
| *Candida albicans* ATCC 10231 | $1.4 \times 10^7$ | 5 min. | >6.1 | >6.1 | 4.8 | <1.0 | <1.0 |

The above results show the overall superiority in germicidal activity of the compositions $X_1$–$X_4$ of the invention to composition E outside the invention.

What is claimed is:

1. A germicidal liquid detergent composition consisting essentially of water and 0.05 to 20% by weight of an active mixture consisting of:

(a) from 50 to 95 parts by weight of a quaternary ammonium compound having the formula

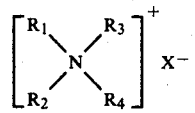

wherein $R_1$ and $R_2$ are alkyl groups each having 9 to 11 carbon atoms; $R_3$ and $R_4$ are each an alkyl group of 1 to 3 carbon atoms, a hydroxyalkyl group of 1 to 3 carbon atoms, an alkylether group of 1 to 3 carbon atoms, or a benzyl group; and $X^-$ is $Cl^-$, $Br^-$, $I^-$, $NO_3^-$, $\frac{1}{2}SO_4^{2-}$, $CH_3SO_4^-$, $C_2H_5SO_4^-$, $\frac{1}{2}HPO_4^{2-}$ or $CH_3COO^-$;

(b) from 5 to 50 parts by weight of a short chain anionic surfactant having 3 to 8 carbon atoms in the hydrophobic group, selected from the group consisting of organic water soluble, single, double or triple charged sulphonates, sulphates, phosphates and carboxylic acid salts and mixtures thereof; and (c) from 0 to 20 parts by weight of a nonionic surfactant, selected from the group consisting of mono- or diethanolamides of $C_{10}$–$C_{16}$ fatty acids; and ethoxylated or propoxylated primary or secondary $C_8$–$C_{16}$ alkanols containing 1 to 4 ethylene oxide or propylene oxide units per molecule; and mixtures thereof.

2. A germicidal detergent composition according to claim 1, wherein $R_1$ and $R_2$ are alkyl groups of equal chain length having 9 to 11 carbon atoms; $R_3$ and $R_4$ are each alkyl groups having 1 to 3 carbon atoms; and $X^-$ is a halogen ion.

3. A germicidal detergent composition according to claim 1, wherein said anionic surfactant has 4–7 carbon atoms in the hydrophobic group.

4. A germicidal detergent composition according to claim 3, wherein said anionic surfactant is an alkali metal $C_4$–$C_7$-alkyl sulphonate or sulphate.

* * * * *